US011632984B2

(12) United States Patent
Alvarez De La Cadena et al.

(10) Patent No.: US 11,632,984 B2
(45) Date of Patent: Apr. 25, 2023

(54) SMOKING ARTICLE MOUTHPIECE FOR RECEIVING AN INSERT UNIT

(71) Applicant: PHILIP MORRIS PRODUCTS S.A., Neuchatel (CH)

(72) Inventors: Antonio Alvarez De La Cadena, Benito Juarez (MX); Ahmet Dincer, Le Mont-sur-Lausanne (CH); Leonardo Nappi, Vallamand (CH)

(73) Assignee: Philip Morris Products S.A., Neuchatel (CH)

( * ) Notice: Subject to any disclaimer, the term of this patent is extended or adjusted under 35 U.S.C. 154(b) by 709 days.

(21) Appl. No.: 16/307,587

(22) PCT Filed: Jul. 6, 2017

(86) PCT No.: PCT/EP2017/067027
§ 371 (c)(1),
(2) Date: Dec. 6, 2018

(87) PCT Pub. No.: WO2018/007561
PCT Pub. Date: Jan. 11, 2018

(65) Prior Publication Data

US 2020/0221761 A1 Jul. 16, 2020

(30) Foreign Application Priority Data

Jul. 7, 2016 (EP) ..... 16178471

(51) Int. Cl.
*A24D 3/02* (2006.01)
*A24D 3/04* (2006.01)
(Continued)

(52) U.S. Cl.
CPC ..... *A24D 3/0216* (2013.01); *A24D 3/04* (2013.01); *A24D 3/048* (2013.01); *A24D 3/061* (2013.01); *A24D 3/067* (2013.01); *A24D 3/17* (2020.01)

(58) Field of Classification Search
CPC ..... A24D 1/002; A24D 1/04; A24D 3/0275; A24D 3/048; A24D 3/061; A24D 3/062;
(Continued)

(56) References Cited

U.S. PATENT DOCUMENTS 4,550,740 A 11/1985 Tilford
4,638,820 A 1/1987 Roberts
(Continued)

FOREIGN PATENT DOCUMENTS

CN 101232825 A 7/2008
CN 201767013 3/2011
(Continued)

OTHER PUBLICATIONS

European Extended Search Report for Application No. 16178471.5 dated Dec. 7, 2016.
(Continued)

*Primary Examiner* — Michael J Felton
(74) *Attorney, Agent, or Firm* — Mueting Raasch Group

(57) ABSTRACT

A smoking article (10) includes an aerosol-generating substrate (12) and a mouthpiece (14) that (i) includes a first hollow tubular segment (24) of elastically deformable material and (ii) is secured to a downstream end of the aerosol-generating substrate; and a second hollow tubular segment (30) adjacent to and upstream of the first hollow tubular segment. The second hollow tubular segment (30) defines a chamber (32) for receiving an insert unit (50). The first hollow tubular segment defines an opening through which an insert unit can pass from the exterior of the mouthpiece
(Continued)

into the chamber (32) of the second hollow tubular segment. At least a portion of the first hollow tubular segment inwardly projects into the opening to define at least one elastically deformable projection (26).

14 Claims, 4 Drawing Sheets

(51) Int. Cl.
*A24D 3/06* (2006.01)
*A24D 3/17* (2020.01)

(58) Field of Classification Search
CPC .... A24D 3/067; A24D 3/0216; A24D 3/0225; A24D 3/022; A24D 3/0212; A24D 3/17; A24D 3/00
See application file for complete search history.

(56) References Cited

U.S. PATENT DOCUMENTS

| | | | | |
|---|---|---|---|---|
| 9,497,991 | B2 | 11/2016 | Besso | |
| 10,426,192 | B2 | 10/2019 | Blick | |
| 10,729,171 | B2 | 8/2020 | Penrose | |
| 2004/0261807 | A1* | 12/2004 | Dube | A24D 3/061 131/337 |
| 2013/0047999 | A1 | 2/2013 | Rushforth | |
| 2014/0202479 | A1 | 7/2014 | Nicholls | |
| 2017/0172200 | A1* | 6/2017 | White | A24F 15/00 |

FOREIGN PATENT DOCUMENTS

| | | | | |
|---|---|---|---|---|
| CN | 202232973 | U | 5/2012 | |
| CN | 104363779 | A | 2/2015 | |
| CN | 104379005 | A | 2/2015 | |
| CN | 204763392 | | 11/2015 | |
| CN | 104780793 | A | 11/2018 | |
| EP | 1754419 | | 2/2007 | |
| EP | 2636323 | | 9/2013 | |
| EP | 2856891 | | 4/2015 | |
| EP | 2723200 | | 6/2016 | |
| EP | 2888959 | | 11/2018 | |
| EP | 2856890 | | 7/2020 | |
| JP | S60-141277 | | 7/1985 | |
| JP | S62-190071 | | 8/1987 | |
| JP | 2009-504175 | | 2/2009 | |
| JP | 2013-514802 | | 5/2013 | |
| JP | 2014-513538 | | 6/2014 | |
| JP | 2014-518079 | | 7/2014 | |
| RU | 2564600 | | 10/2015 | |
| RU | 2573288 | | 1/2016 | |
| WO | WO 2007/060543 | | 5/2007 | |
| WO | WO 2011/077141 | | 6/2011 | |
| WO | WO 2011/148130 | | 12/2011 | |
| WO | WO 2012/156695 | | 11/2012 | |
| WO | WO-2012156703 | A1 * | 11/2012 | A24D 3/048 |
| WO | WO 2013/000967 | | 1/2013 | |
| WO | WO-2013068398 | A1 * | 5/2013 | A24D 3/041 |
| WO | WO 2013/178515 | | 12/2013 | |
| WO | WO-2014023557 | A1 * | 2/2014 | A24D 3/048 |
| WO | WO-2014158051 | A1 * | 10/2014 | A24D 3/04 |
| WO | WO-2015190256 | A1 * | 12/2015 | A24D 3/14 |
| WO | WO-2016016252 | A1 * | 2/2016 | A24D 1/02 |

OTHER PUBLICATIONS

PCT/EP2017/067027 Search Report and Written Opinion dated Oct. 4, 2017 (8 pages).
Office Action issued in Russia for Application No. 2018144555/11 dated Oct. 20, 2020 (10 pages). English translation included.
Office Action issued in Japan for Application No. 2018-564763 dated Apr. 1, 2021 (5 pages). English translation included.
Office Action issued in China for Application No. 201780037039.2 dated Dec. 30, 2020 (12 pages). English translation included.

* cited by examiner

SMOKING ARTICLE MOUTHPIECE FOR RECEIVING AN INSERT UNIT

This application is a U.S. National Stage Application of International Application No. PCT/EP2017/067027 filed Jul. 6, 2017, which was published in English on Jan. 11, 2018, as International Publication No. WO 2018/007561 A1. International Application No. PCT/EP2017/067027 claims priority to European Application No. 16178471.5 filed Jul. 7, 2016.

The present invention relates to a smoking article configured to receive an insert unit at its downstream end. The invention is particularly applicable to filter cigarettes configured to receive a frangible capsule at their downstream end.

Filter cigarettes are one example of smoking articles. Filter cigarettes typically comprise a rod of tobacco cut filler surrounded by a paper wrapper and a cylindrical filter aligned in end-to-end relationship with the wrapped tobacco rod, with the filter attached to the tobacco rod by tipping paper. In conventional filter cigarettes, the filter may consist of a plug of cellulose acetate tow wrapped in porous plug wrap. Filter cigarettes with multi-component filters that comprise two or more segments of filtration material for the removal of particulate and gaseous components of the mainstream smoke are also known.

A number of smoking articles in which an aerosol forming substrate, such as tobacco, is heated rather than combusted have also been proposed in the art. In heated smoking articles, the aerosol is generated by heating the aerosol forming substrate. Known heated smoking articles include, for example, smoking articles in which an aerosol is generated by electrical heating or by the transfer of heat from a combustible fuel element or heat source to an aerosol forming substrate. During smoking, volatile compounds are released from the aerosol forming substrate by heat transfer from the heat source and entrained in air drawn through the smoking article. As the released compounds cool, they condense to form an aerosol that is inhaled by the consumer. Also known are smoking articles in which a nicotine-containing aerosol is generated from a tobacco material, tobacco extract, or other nicotine source, without combustion, and in some cases without heating, for example through a chemical reaction.

It is known to incorporate additives, such as flavourants, into smoking articles in order modify the smoking experience for a consumer. One known way to incorporate additives, such as flavourants, into a smoking article is in the form of a crushable capsule. The capsules typically comprise a frangible wall enclosing a liquid additive. A consumer can apply a force to the capsule to rupture the wall and thus release the additive, thereby allowing a consumer to modify their smoking experience.

However, such capsules are incorporated into a smoking article during manufacture, for example, by embedding them in a segment of fibrous filtration material, such as cellulose acetate tow. Consequently, a consumer is restricted to using additives that are already provided as part of the manufactured smoking article.

WO2013000967 A1 describes a filter having a mouth end recess that is configured to receive and retain a complementary-shaped insertable filter unit. If a capsule is to be inserted into the mouth end recess, the capsule needs to be first embedded in plug of filtration material, with said plug then being inserted into the recess. The plug is compressed during insertion to form a snug fit within the recess, so as to retain the plug therein.

It would therefore be desirable to improve the manner by which a consumer can customise their smoking experience, and in particular, customise the type of additive or flavour that they can use when smoking a smoking article.

According to a first aspect of the invention, there is provided a smoking article comprising: an aerosol-generating substrate and a mouthpiece secured to a downstream end of the aerosol-generating substrate. The mouthpiece comprises: a first hollow tubular segment of elastically deformable material; and a second hollow tubular segment adjacent to and upstream of the first hollow tubular segment, the second hollow tubular segment defining a chamber for receiving an insert unit. The first hollow tubular segment defines an opening through which an insert unit can pass from the exterior of the mouthpiece into the chamber of the second hollow tubular segment. At least a portion of the first hollow tubular segment inwardly projects into the opening to define at least one elastically deformable projection.

The arrangement of the first hollow tubular segment and the second hollow tubular segment enables a consumer to incorporate an insert unit into the mouthpiece of the smoking article, after the smoking article has been manufactured and supplied to the consumer. The insert unit can be configured to modify at least one characteristic of the smoking article. Consequently, the consumer is able to customise their smoking experience by selecting whether or not to introduce one or more insert units to the mouthpiece of the smoking article.

Furthermore, unlike prior art recess filters such as those of WO2013000967 A1, the first hollow tubular segment is adjacent to a second hollow tubular segment, and comprises at least one elastically deformable projection that inwardly projects into the opening of the first hollow tubular segment. By providing the at least one elastically deformable projection that inwardly projects into the opening of the first hollow tubular segment, the insert unit can be easily inserted into the mouthpiece without a great risk of damaging the insert unit during insertion. This is because the projection can be deformed and deflected by the unit, as the unit passes through the opening, without imposing too large a resistive or compressive force on the unit. However, once the unit has passed through the opening and resides in the chamber of the second hollow tubular element, the projection can elastically revert to its previous state to provide a barrier that prevents or inhibits the insert unit from exiting the mouthpiece. In particular, the projection can elastically revert to a position that results in the opening of the first hollow tubular segment having a cross-section area that does not fully encompass the cross sectional area of the insert unit contained within the chamber. Namely, the elastically deformable projection provides at least a partial enclosure surface downstream of the chamber to secure the insert unit in the chamber. Consequently, the insert unit is retained within the chamber and prevented from exiting the mouthpiece.

The present invention is particularly suited to use with fragile insert units, such a frangible capsules, which are configured to break or rupture when subjected to an external force. In such scenarios, the arrangement of at least one elastically deformable projection can ensure that the capsule is not subjected to too high a compressive force as it passes through the opening, and therefore is not undesirably ruptured as it is passes into the chamber of the mouthpiece.

Accordingly, the present invention provides a reliable and effective way for enabling a consumer to insert an insert unit into the mouthpiece of a smoking article, without a great risk of damaging the insert unit during insertion. A consumer can therefore conveniently customise their smoking experience by selecting whether or not to introduce one or more insert units to the mouthpiece of the smoking article.

The first hollow tubular segment has an opening through which an insert unit can pass from the exterior of the mouthpiece into the chamber of the second hollow tubular segment. Therefore, preferably, the first hollow tubular segment is disposed at the downstream end of the mouthpiece. Put another way, preferably the first hollow tubular segment defines the downstream end face of the mouthpiece.

Alternatively, the mouthpiece may comprise a portion downstream of the first hollow tubular segment. In such embodiments, the portion downstream of the first hollow tubular segment should be configured to allow for an insert unit to pass from the exterior of the mouthpiece to the opening of the first hollow tubular segment. The portion downstream of the first hollow tubular segment may therefore consist of one or more further hollow tubular segments. Alternatively or additionally, the portion downstream of the first hollow tubular segment may consist of a mouth end cavity formed by one or more wrappers extending downstream of the first hollow tubular segment.

The at least one elastically deformable projection inwardly projects into the opening, in order to reduce the amount of internal surface of the first hollow tubular segment that can come into contact with a filter unit as it passes through the opening. This has an additional synergistic benefit, in that the projection can then act as a barrier to avoid the unit from exiting the chamber of the second hollow tubular segment.

The at least one elastically deformable projection may have any suitable profile as viewed from the downstream end of the smoking article or mouthpiece. In particular, the opening can have a perimeter as viewed from the downstream end of the smoking article or mouthpiece. When viewed from the downstream end of the smoking article or mouthpiece, each projection of the first hollow tubular segment is delimited by a first portion of the perimeter and an imaginary straight line that intersects each end of the first portion of the perimeter. Preferably, the distance between the imaginary straight line and the point on the first portion of the perimeter furthest from the imaginary straight line, in a direction perpendicular to the imaginary straight line, is at least about 1 millimetre, more preferably, at least about 2 millimetres. Each projection may therefore have straight or curved side portions, as viewed from the downstream end of the smoking article or mouthpiece. Each projection may have a pointed or rounded tip, as viewed from the downstream end of the smoking article or mouthpiece.

Preferably, the shape of the opening has at least one degree of bilateral symmetry as viewed from the downstream end of the smoking article or mouthpiece. Preferably, the shape of the opening has radial symmetry as viewed from the downstream end of the smoking article or mouthpiece.

The insert unit may be any component that can be inserted into a smoking article mouthpiece. Preferably, the insert unit is capable of altering at least one characteristic of the smoking experience. For example, the insert unit may comprise filtration material, and thus may reduce the quantity of certain constituents of the mainstream smoke or vapour passing through the mouthpiece. The insert unit may alter the flow of the mainstream smoke or vapour through the mouthpiece. For example, the mainstream smoke or vapour may preferentially flow through the insert unit or the insert unit may act as a flow restrictor. The insert unit in this case may have a higher or a lower resistance to draw than other components of the mouthpiece.

Preferably, the insert unit is configured to impart at least one flavour into the mainstream smoke or vapour passing through the mouthpiece. The insert unit may comprise, for example, a flavour bead or a flavour thread. However, preferably, the insert unit comprises a frangible capsule, more preferably a frangible flavour capsule.

The frangible capsule may be provided as part of the filter unit, for example, a frangible capsule embedded in a plug of filtration material. Alternatively, in some preferred embodiments, the insert unit consists solely of the frangible capsule.

The frangible capsule preferably comprises a frangible shell enclosing a payload comprising at least one additive capable of modifying the mainstream smoke or vapour passing through the mouthpiece. Preferably, the payload is a liquid payload.

The first hollow tubular segment may have only one projection. This can reduce the complexity of manufacturing the first hollow tubular segment.

Alternatively, in some preferred embodiments, the first hollow tubular segment comprises two or more elastically deformable projections that inwardly project into the opening. In such embodiments, preferably, two or more of the elastically deformable projections are uniformly disposed around the opening. For example, the first hollow tubular segment may comprise two elastically deformable projections diametrically opposed around the opening. As another example, the first hollow tubular segment may comprise three elastically deformable projections disposed around the opening, with each projection being disposed at the tip of an imaginary equilateral triangle, as viewed from the downstream end face of the mouthpiece. This uniform distribution can enhance the effectiveness of the projections in allowing an insert unit to pass into the chamber, and subsequently be retained in the chamber. That is, the uniform distribution can allow the compressive force that is applied by the hollow tubular segment to the insert unit, as the insert unit passes through the opening, to be more evenly distributed. This can further reduce the risk of damage to the insert unit as it is inserted into the chamber. This is therefore particularly advantageous when the insert unit is fragile, such as a frangible capsule.

Preferably, the at least one projection delimits the shape of the opening, as viewed from the downstream end of the smoking article or mouthpiece, such that the opening cannot fully encompass a circle having a diameter of from about 3 millimetres to about 4 millimetres. Such circular diameters correspond to the diameters of a typical frangible capsule for a smoking article. Consequently, such a capsule could not pass through the opening without first deforming a portion of the first hollow tubular segment.

In order to effectively retain an insert unit in the chamber after it has passed through the opening of the first hollow tubular segment, it is preferably for there to be a greater amount of space in the chamber than in the opening of the first hollow tubular segment. Consequently, it is preferable for the cross sectional area of the opening of the first hollow tubular segment to be less than the cross sectional area of the chamber of the second hollow tubular segment. This can help to create a step between the two hollow tubular segments that can assist in preventing the insert unit from exiting the chamber. Preferably, the central longitudinal axis of the mouthpiece extends through both the opening of the first hollow tubular member and the chamber of the second hollow tubular member.

This may be expressed in terms of an equivalent diameter (Deq.), which is the diameter of a circle having the same area as that of the shape of the opening. Therefore, preferably, the cross sectional area of the opening of the first hollow tubular segment has an equivalent diameter (Deq.) of about 90 percent or less, more preferably about 70 percent or less, even more preferably about 60 percent or less than the equivalent diameter (Deq.) of the cross sectional area of the chamber of the second hollow tubular segment. The equivalent diameter (Deq.) can be calculated using the following formula:

$$Deq=2\times\sqrt{S\div\pi}$$

where S is the cross sectional area of the hollow tube at a given longitudinal position, and π is the mathematical constant "pi". In the case of the first hollow tubular segment, S is the cross sectional area of the hollow tube at a longitudinal position where the at least one projection resides.

Preferably, the cross sectional area of the opening of the first hollow tubular segment has an equivalent diameter (Deq.) of from about 2.5 millimetres to about 4.5 millimetres.

Preferably, the cross sectional area of the chamber of the second hollow tubular segment has an equivalent diameter (Deq.) of from about 2.8 millimetres to about 6.9 millimetres.

Preferably, the cross sectional area of the opening of the first hollow tubular segment does not change along the longitudinal axis for the mouthpiece. In this case, preferably the projections reside along the entire length of the first hollow tubular segment. This may help to ease the manufacture of the first hollow tubular segment. Alternatively, in some embodiments the cross sectional area of the opening of the first hollow tubular segment changes along the longitudinal axis for the mouthpiece. For example, the opening the first hollow tubular segment may taper, such that it has a smaller cross sectional area at one end of the first hollow tubular segment. As another example, the projections may only reside along a certain longitudinal part or parts of the first hollow tubular segment. In this case, the projections may not reside at the downstream end of the first hollow tubular segment, but instead reside at the upstream end of the first hollow tubular segment. This could enable the opening of the first hollow tubular segment to have a more conventional shape (such as a circular shape) at the downstream end of the first hollow tubular segment, whilst still benefiting from the advantages provided by the at least one projection, described above.

The second hollow tubular segment may be the most upstream segment of the mouthpiece. In such embodiments, the second hollow tubular segment is directly adjacent to the downstream end of the aerosol generating substrate. However, preferably the mouthpiece further comprises a segment of filtration material adjacent to and upstream of the second hollow tubular segment. The segment of filtration material is preferably a plug of fibrous filtration material, such as a plug of cellulose acetate tow. This provides an upstream end face to the chamber of the second hollow tubular segment. Such an upstream segment of fibrous filtration material can be advantageous when the insert unit is a capsule having frangible shell enclosing a liquid payload. This is because the liquid payload can stick to the fibrous material after the capsule has been ruptured, and help to retain fragments of the capsules shell in the chamber.

Preferably, the segment of filtration material has a different colour from the colour of the first hollow tubular segment. This can make it easier for a consumer to discern the perimeter of the opening in the first hollow tubular segment.

The mouthpiece may further comprise one or more wrappers circumscribing the hollow tubular segments. In particularly preferred embodiments, the mouthpiece further comprises an impermeable wrapper circumscribing at least the first hollow tubular segment and the second hollow tubular segment. The impermeable wrapper can be advantageous when the insert unit is a capsule having frangible shell enclosing a liquid payload. This is because the impermeable wrapper can prevent the liquid payload from seeping through to the exterior surface of the mouthpiece. The impermeable wrapper may comprises a substrate, such as a paper substrate, that is coated with a coating impermeable to liquid. Suitable coatings include, but are not limited to, nitrocellulose and ethyl-cellulose.

The first hollow tubular segment may be formed from any suitable elastically deformable material. For example, the first hollow tubular segment may be formed from foamed material or rubber.

In preferred embodiments, the elastically deformable material of the first hollow tubular segment comprises fibrous filtration material. The fibrous filtration material may comprise cellulose based fibers, such as cellulose acetate fibers. In such embodiments, the first hollow tubular segment may be understood to be a type of hollow acetate tube.

A plasticiser may be added to the fibrous filtration material to adjust the elastic properties of the first hollow tubular segment. Such plasticisers include triacetin, and triethylenglycol di-acetate. Where a plasticiser is included in the first hollow tubular segment, preferably the plasticiser is included in an amount of from about 13 percent weight to about 25 percent weight of the total weight of the first hollow tubular segment.

Where each of the first hollow tubular segment and the second hollow tubular segment comprises fibrous filtration material and a plasticiser added to the fibrous filtration material, preferably the percentage weight content of the plasticiser in the first hollow tubular segment is higher than the percentage weight content of the plasticiser in the second hollow tubular segment. This can advantageously allow the second hollow tubular segment to deform more readily than the first hollow tubular segment, if a consumer wishes to interact with an insert unit in the chamber, such as by breaking a frangible capsule. In particular, this means that the size and shape of the opening of the first hollow tubular segment is less likely to change when the second hollow tubular segment is subjected to an external force. Consequently, it is less likely that an insert unit can accidentally exit the mouthpiece, when a consumer is applying a force to the second hollow tubular segment.

The second hollow tubular segment may be formed from any suitable material. Preferably, the second hollow tubular segment comprises a permeable peripheral portion and a hollow central core or chamber. Preferably, the second hollow tubular segment comprises fibrous filtration material. That is, preferably the permeable peripheral portion of the second hollow tubular segment comprises fibrous filtration material. The fibrous filtration material may comprise cellulose based fibers, such as cellulose acetate fibers. In such embodiments, the first hollow tubular segment may be understood to be a type of hollow acetate tube. By providing the second hollow tubular segment with a permeable peripheral portion, smoke can still flow through the segment, even if the chamber is filled with an impermeable insert unit. For example, if the chamber is provided with a frangible capsule, a consumer can still smoke the smoking article without breaking the capsule, since smoke can pass through the permeable peripheral portion. This provides the consumer with the ability to customise when to rupture the capsule during their smoking experience, rather than necessarily requiring them to rupture the capsule prior to smoking.

When the second hollow tubular segment comprises fibrous filtration material, a plasticiser may be added to the fibrous filtration material. Such plasticisers include triacetin, and triethylenglycol di-acetate. The plasticiser may be included in the second hollow tubular segment in an amount of from about 5 percent weight to about 10 percent weight of the total weight of the first hollow tubular segment.

Preferably, the first hollow tubular segment has a length in the longitudinal direction of the mouthpiece of from about 3 millimetres to about 10 millimetres, preferable about 4 millimetres to about 7 millimetres, most preferably about 5 millimeters. Such a length can help to ensure that the insert unit does not have to travel too far to reach the chamber, and therefore is not subjected to too high a compressive force for too long a duration as it passes through the opening. Furthermore, such a length can also help to ensure that the at least one projection can form a sufficiently resilient barrier to prevent an insert unit, or fragments thereof, from undesirably exiting the mouthpiece.

Preferably, the second hollow tubular segment has a length of from about 4 millimetres to about 12 millimetres, preferable about 5 millimetres to about 10 millimetres, most preferably about 5 millimeters or 7 millimeters. This can allow the chamber to be sufficiently sized to accommodate at least two insert units, and in particular, at least two frangible flavour capsules. The ability to accommodate at least two insert units can provide the consumer with more degree of choice over how they customise their smoking article mouthpiece, since it allows the consumer to choose between different combinations of insert units.

It will be appreciated that, although the invention has been described above in respect of a smoking article, the advantages and technical effects of the invention are equally applicable to a mouthpiece for a smoking article. Consequently, according to a second aspect of the present invention, there is provided a mouthpiece for a smoking article, the mouthpiece comprising: a first hollow tubular segment of elastically deformable material; and a second hollow tubular segment adjacent to and upstream of the first hollow tubular segment, the second hollow tubular segment defining a chamber for receiving an insert unit. The first hollow tubular segment defines an opening through which an insert unit can pass from the exterior of the mouthpiece into the chamber of the second hollow tubular segment. At least a portion of the first hollow tubular segment inwardly projects into the opening to define at least one elastically deformable projection.

It will be appreciated that preferred features described above in relation to the first aspect of the invention may also be applicable to the second aspect of the invention.

The terms "upstream" and "downstream" refer to relative positions of elements of the smoking article or mouthpiece described in relation to the direction of mainstream smoke as it is drawn from the aerosol generating substrate and through the filter or mouthpiece.

As used herein, the term "longitudinal" refers to a direction parallel to the length of the aerosol-generating article.

Smoking articles according to the present invention may be filter cigarettes or other smoking articles in which an aerosol-generating substrate comprises a tobacco material that is combusted to form smoke. Therefore, in any of the embodiments described above, the aerosol-generating substrate may comprise a tobacco rod. Furthermore, in any of the embodiments described above, the mouthpiece may be a filter. In such embodiments, the filter may be secured to the tobacco rod by a tipping paper.

Alternatively, smoking articles according to the present invention may be articles in which a tobacco material is heated to form an aerosol, rather than combusted. In one type of heated aerosol-generating article, a tobacco material is heated by one or more electrical heating elements to produce an aerosol. In another type of heated aerosol-generating article, an aerosol is produced by the transfer of heat from a combustible or chemical heat source to a physically separate tobacco material, which may be located within, around or downstream of the heat source. The present invention further encompasses aerosol-generating articles in which a nicotine-containing aerosol is generated from a tobacco material, tobacco extract, or other nicotine source, without combustion, and in some cases without heating, for example through a chemical reaction.

The invention will now be further described, by way of example only, with reference to the accompanying drawings in which.

Figure 1:
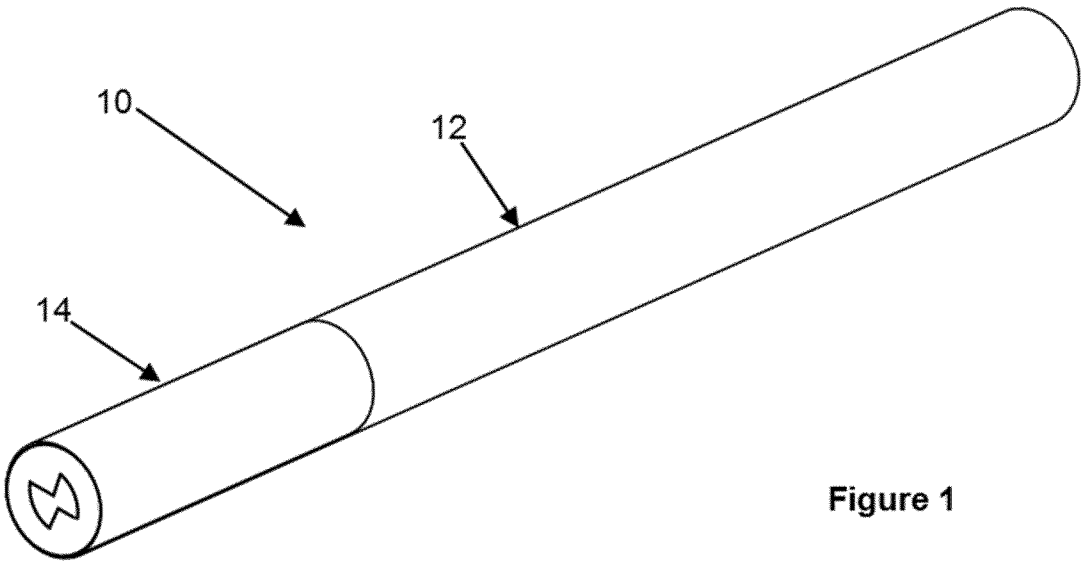
FIG. 1 shows a smoking article in accordance with the present invention.
Figure 2:
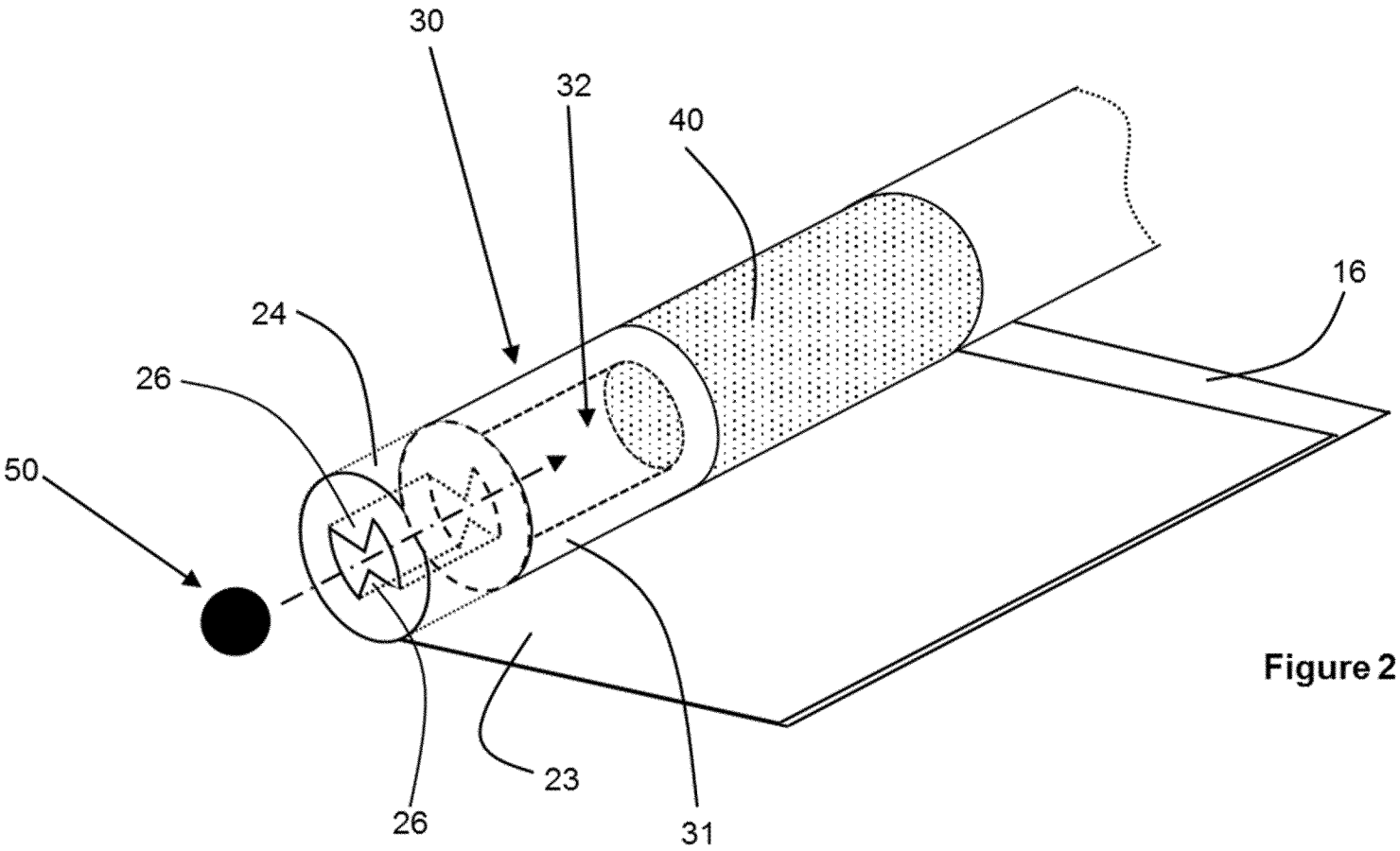
FIG. 2 shows a partially transparent view of the smoking article of FIG. 1 with the filter unwrapped.

FIGS. 1 and 2 illustrate a smoking article 10 in accordance with the present invention. The smoking article 10 comprises a wrapped rod 12 of tobacco cut filler which is attached at one end to an axially aligned filter 14. A band of tipping paper 16 circumscribes the filter 14 and a portion of the wrapped rod 12 of tobacco to join together the two portions of the smoking article 10.

As shown in FIG. 2, the filter 14 comprises a first hollow tubular segment 24. The first hollow tubular segment 24 is formed of elastically deformable fibrous filtration material, such as cellulose acetate tow. In the FIG. 2 smoking article, the first hollow tubular segment 24 is at the downstream end of the filter 14. However, in some cases the filter can include one or more further hollow tubular segments downstream of the first hollow tubular segment. Alternatively or additionally, the portion downstream of the first hollow tubular segment may consist of a mouth end cavity formed by one or more wrappers (23) extending downstream of the first hollow tubular segment.

Upstream of the first hollow tubular segment 24 is a second hollow tubular segment 30, also formed of fibrous filtration material, such as cellulose acetate tow. The second hollow tubular segment 30 has a peripheral portion 31 formed of fibrous filtration material, such as cellulose acetate tow. As seen in FIG. 2, the second hollow tubular segment 30 is adjacent to the first hollow tubular segment 24.

The second hollow tubular segment 30 defines a chamber 32 for receiving an insert unit 50, such as a capsule 50, as indicated by the dotted arrow in FIG. 2. Adjacent to and upstream of the second hollow tubular segment 30 is a plug of filtration material 40, such as a plug of cellulose acetate tow. An exploded view of the first hollow tubular segment 24, second hollow tubular segment 30 and plug of filtration material 40 can be seen in FIG. 3.

Figure 3:
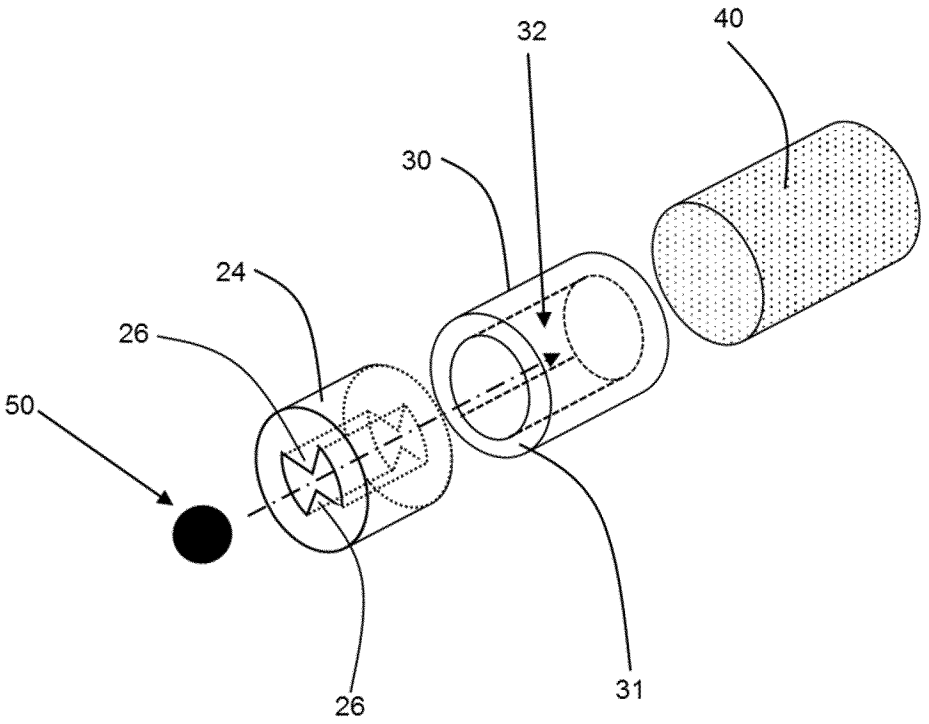
FIG. 3 shows an exploded view of some of the components of FIG. 2.

As can be best seen from FIGS. 2 and 3, the first hollow tubular segment 24 defines an opening through which an insert unit 50 can pass from the exterior of the mouthpiece into the chamber 32 of the second hollow tubular segment 30. Two portions of the first hollow tubular segment 24 inwardly project into the opening to define two elastically deformable projections 26 at the downstream end of the filter 14. These projections help to reduce the cross sectional area of the opening relative to the cross sectional area of the chamber 32.

Figure 4:
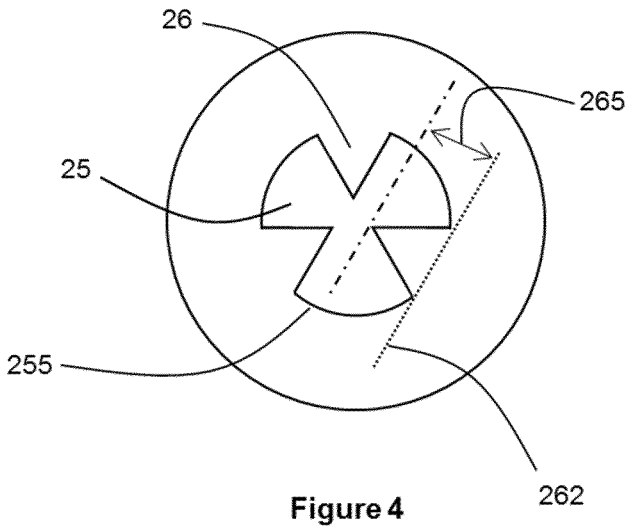
FIGS. 4 to 6 show exemplary shapes for the opening at the downstream end of a smoking article in accordance with the present invention.
Figure 5:
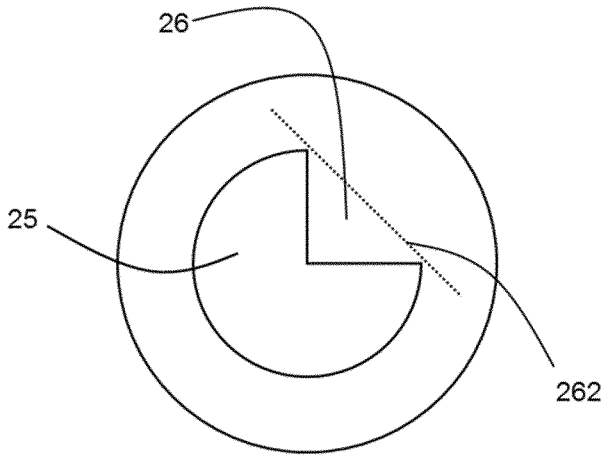
Figure 6:
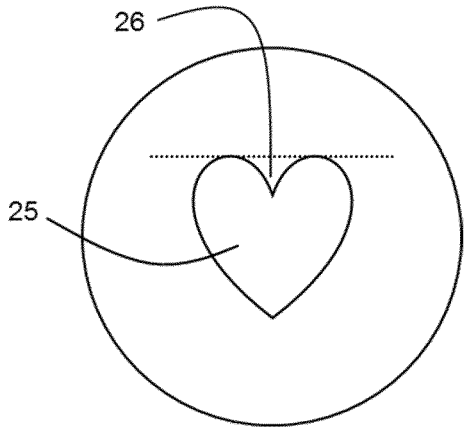

Accordingly, a consumer can insert the insert unit 50, through the opening of the first hollow tubular segment 24, and into the chamber 32 of the second hollow tubular segment 30. During insertion, the projections 26 elastically deform to allow passage of the insert unit 50 through the opening. After the insert unit 50 has passed into the chamber 32, the projections 26 revert to their previous state and provide a barrier that prevents the insert unit 50 from exiting the mouthpiece FIGS. 4 to 6 show exemplary shapes for the opening at the downstream end of a smoking article in accordance with the present invention, as viewed from the downstream end of the smoking article at a point along the central longitudinal axis of the smoking article. In FIG. 4, there are three elastically deformable projections 26 uniformly disposed around the opening 25, with each projection 26 being disposed at the tip of an imaginary equilateral triangle. That is, the projections 26 are equally spaced around the opening 25.

As can be seen from FIG. 4, the opening 25 has a perimeter 255 as viewed from the downstream end of the smoking article. Each projection 26 of the first hollow tubular segment 24 is delimited by a first portion of the perimeter and an imaginary straight line 262 that intersects each end of the first portion of the perimeter. The distance 265 between the straight line 262 and the point on the first portion of the perimeter furthest from the straight line in a direction perpendicular to the straight line corresponds to the 'height' 265 of the projection 26.

FIGS. 5 and 6 show further exemplary shapes for the opening 25 at the downstream end of a smoking article in accordance with the present invention. In each of FIGS. 5 and 6, there is only a single elastically deformable projection 26 that inwardly projects into the opening 25. In FIG. 5, the opening 25 is pie-shaped. In FIG. 6, the opening 25 is heart-shaped.

The invention claimed is:

1. A smoking article comprising:

an aerosol-generating substrate and a mouthpiece secured to a downstream end of the aerosol-generating substrate, the mouthpiece comprising:

a first hollow tubular segment of elastically deformable material; and a second hollow tubular segment adjacent to and upstream of the first hollow tubular segment, the second hollow tubular segment comprising a permeable peripheral portion of a fibrous filtration tow surrounding a hollow defining a chamber for receiving an insert unit;

wherein the first hollow tubular segment defines an opening through which the insert unit can pass from the exterior of the mouthpiece into the chamber of the second hollow tubular segment, and wherein at least a portion of the first hollow tubular segment inwardly projects into the opening to define at least one elastically deformable projection.

2. The smoking article according to claim 1, wherein the first hollow tubular segment comprises two or more elastically deformable projections uniformly disposed around the opening.

3. The smoking article according to claim 1, wherein the shape of the opening has at least one degree of bilateral symmetry as viewed from the downstream end of the smoking article or mouthpiece.

4. The smoking article according to claim 1, where the shape of the opening has radial symmetry as viewed from the downstream end of the smoking article or mouthpiece.

5. The smoking article according to claim 1, wherein the cross sectional area of the opening of the first hollow tubular segment has an equivalent diameter (Deq.) of about 90 percent or less than an equivalent diameter (Deq.) of the cross sectional area of the chamber of the second hollow tubular segment.

6. The smoking article according to claim 1, wherein the cross sectional area of the opening of the first hollow tubular segment has an equivalent diameter (Deq.) of from about 2.5 millimetres to about 4.5 millimetres.

7. The smoking article according to claim 1, wherein the mouthpiece further comprises a segment of filtration material adjacent to and upstream of the second hollow tubular segment.

8. The smoking article according to claim 7, wherein the first hollow tube segment has a colour and wherein the segment of filtration material has a different colour from the colour of the first hollow tubular segment.

9. The smoking article according to claim 1, wherein the mouthpiece further comprises an impermeable wrapper circumscribing at least the first hollow tubular segment and the second hollow tubular segment.

10. The smoking article according to claim 1, wherein the first hollow tubular segment comprises fibrous filtration material and a plasticiser added to the fibrous filtration material, wherein the second hollow tubular segment comprises a plasticizer added to the fibrous filtration tow, and wherein the percentage weight content of the plasticiser in the first hollow tubular segment is higher than the percentage weight content of the plasticiser in the second hollow tubular segment.

11. The smoking article according to claim 1, wherein the first hollow tubular segment has a length of from about 3 millimetres to about 10 millimetres.

12. The smoking article according to claim 1, wherein the second hollow tubular segment has a length of from about 4 millimetres to about 10 millimetres.

13. The smoking article according to claim 1, where the first hollow tubular segment of elastically deformable material is arranged at the downstream end of the mouthpiece.

14. A mouthpiece for a smoking article, the mouthpiece comprising:

a first hollow tubular segment of elastically deformable material; and a second hollow tubular segment adjacent to and upstream of the first hollow tubular segment, the second hollow tubular segment comprising a permeable peripheral portion of fibrous filtration tow surrounding a hollow chamber for receiving an insert unit;

wherein the first hollow tubular segment defines an opening through which the insert unit can pass from the exterior of the mouthpiece into the chamber of the second hollow tubular segment, and wherein at least a portion of the first hollow tubular segment inwardly projects into the opening to define at least one elastically deformable projection.

* * * * *